US005701115A

United States Patent [19]

Right et al.

[11] Patent Number: 5,701,115

[45] Date of Patent: Dec. 23, 1997

[54] FIELD PROGRAMMABLE MODULE PERSONALITIES

[75] Inventors: Robert W. Right, Huntington, Conn.; Hilario S. Costa, Sarasota; John P. Hewlin, Bradenton, both of Fla.

[73] Assignee: General Signal Corporation, Stamford, Conn.

[21] Appl. No.: 441,792

[22] Filed: May 16, 1995

[51] Int. Cl.[6] ..... G08B 26/00

[52] U.S. Cl. ..... 340/286.05; 340/505; 340/508; 340/516; 340/825.06; 340/825.16; 340/825.17

[58] Field of Search ..... 340/286.05, 516, 340/518, 505, 508, 825.06, 825.16, 825.17, 953, 642

[56] References Cited

U.S. PATENT DOCUMENTS

| | | | |
|---|---|---|---|
| 4,901,316 | 2/1990 | Igarashi et al. | 371/37.1 |
| 4,954,809 | 9/1990 | Right et al. | 340/516 |
| 4,962,368 | 10/1990 | Dobrzanski et al. | 340/514 |
| 5,017,905 | 5/1991 | Yuchi | 340/506 |
| 5,039,980 | 8/1991 | Aggers et al. | 340/505 |
| 5,117,219 | 5/1992 | Tice et al. | 340/518 |
| 5,267,180 | 11/1993 | Okayama | 364/571.03 |
| 5,298,223 | 3/1994 | Berger et al. | 422/54 |
| 5,347,515 | 9/1994 | Marino | 370/85.2 |
| 5,351,034 | 9/1994 | Berger et al. | 340/577 |
| 5,389,914 | 2/1995 | Kikuchi | 340/505 |
| 5,422,626 | 6/1995 | Fish | 340/505 |
| 5,428,341 | 6/1995 | Takahashi | 340/505 |
| 5,428,343 | 6/1995 | Kikuchi et al. | 340/505 |
| 5,475,363 | 12/1995 | Suzuki et al. | 340/505 |
| 5,493,271 | 2/1996 | Koboyashi et al. | 340/505 |
| 5,525,962 | 6/1996 | Tice | 340/505 |

FOREIGN PATENT DOCUMENTS

| | | |
|---|---|---|
| 485878 A2 | 5/1992 | European Pat. Off. . |
| 3128777 A1 | 2/1983 | Germany . |
| 3128788 A1 | 2/1983 | Germany . |
| 3128796 A1 | 2/1983 | Germany . |
| 3128811 A1 | 2/1983 | Germany . |
| 3415819 A1 | 10/1985 | Germany . |
| 4027656 A1 | 3/1992 | Germany . |

*Primary Examiner*—Jeffery Hofsass
*Assistant Examiner*—Ashok Mannava
*Attorney, Agent, or Firm*—Ohlandt, Greeley Ruggiero & Perle

[57] ABSTRACT

There is provided an alarm system for detecting and warning of the presence of alarm and trouble conditions in a plurality of zones. The system comprises a loop controller having supply lines extending to the plurality of zones and a module connected to the supply lines within each zones. If an alarm condition occurs in a particular zone, the module initiates communication of the alarm condition to the loop controller. The system also includes means for variably controlling a specific personality of the module, such as a microcontroller, so that the module functions selectively in a variety of specific ways. The means for variably controlling includes means for selectively storing configuration data, such as an EEPROM, in the module to define the specific personality.

8 Claims, 15 Drawing Sheets

FIELD PROGRAMMABLE MODULE PERSONALITIES

The present invention relates to a microprocessor-controlled universal module, and other modules, that are used within a fire alarm and detection system for the detection and indication of fire-related emergency conditions. Generally, a fire alarm and detection system comprises a fire alarm loop controller that extend control to a loop of devices, such as to input/output transponders and fire/smoke detectors, and the like, the universal module of the present invention being one example of such device. More particularly, the present invention relates to a field programmable, universal module having the flexibility to change functions or personalities upon receipt of software configuration commands from the fire alarm loop controller.

The invention of this application is related to inventions described in four other applications with reference to the same fire alarm and detection system: U.S. patent application Ser. No. 08/441,811 filed on May 16, 1995 now U.S. Pat. No. 5,644,293 entitled Ground Fault Detection With Location Identification (Docket No. 100.0601); U.S. patent application Ser. No. 08/441,754 filed on May 16, 1995 entitled Line Monitor For 2-Wire Data Transmission (Docket No. 100.0602); U.S. patent application Ser. No. 08/441,803 filed on May 16, 1995 entitled Standalone-mode For Alarm-type Module Personalities (Docket No. 100.0603); and U.S. patent application Ser. No. 08/441,762 filed on May 16, 1995 entitled Loadshed Method of Power Conservation (Docket No. 100.0604).

BACKGROUND OF THE INVENTION

The present invention is in the field of fire alarm and detection systems. Examples of prior systems of this general type may be appreciated by reference to following U.S. patents: U.S. Pat. No. 4,568,919 to J. Muggli, et al., which issued on Feb. 4, 1986; U.S. Pat. No. 4,752,698 to A. Fumyama, et al., which issued on Jun. 21, 1988; U.S. Pat. No. 4,850,018 to W. R. Vogt, which issued on Jul. 18, 1989; U.S. Pat. No. 4,954,809 to R. W. Right, et al., which issued on Sep. 4, 1990; U.S. Pat. No. 4,962,368 to J. J. Dobrzanski, et al, which issued on Oct. 9, 1990.

Most of the above cited U.S. patents describe systems that are approximately six to ten years old, and in most of these systems the loop controller initiates the determination of the states of the units at the various zones or stations in the system by the use of a repetitive polling scheme for polling the detector units or stations from the loop controller, whereby addresses are sent successively on the loop or lines to determine which, if any, units are in an alarm state. Provision is also made in most of these systems to detect trouble conditions in the system.

Other fire detector and alarm systems have been developed in the recent past, that is, in the past five years or so, that provide a variety of features, including the feature of an intelligent transponder combined with an integral processor, such that communication to the loop controller of the fact that a particular transponder is in alarm is initiated by the transponder. This is sometimes called polling by exception. This results in lower communications speed while substantially improving control panel response time. Such a feature makes the system less sensitive to line noise and to loop wiring properties; hence, twisted or shielded wire is not required.

The above described intelligent transponder feature may be appreciated by reference to several U.S. Patents. Many of these prior art patents describe central receivers having improved intelligence for communication with a plurality of satellite devices. For example, U.S. Pat. No. 4,901,316 to A. Igarashi, et al. entitled DISASTER PREVENTION MONITORING AND CONTROL FACILITY provides a receiver for polling a plurality of terminal units. The receiver reads terminal information from the terminals, analyzes the terminal information, and displays the results of its analysis. Also, the receiver monitors the accuracy of transmissions between the receiver and the terminal units. Thus, the receiver can accurately check for an erroneous transmission of a signal that may occur between the receiver and one of the terminal units.

The feature of improving the intelligence of satellite devices that are connected to a central receiver is also known. For fire alarm systems, one Or more unaddressable slave device may be connected to a single addressable master device that is, in turn, connected to a central receiving unit. The master device makes decisions, such as whether a particular surveillance area is in alarm, on behalf of the slave devices. For example, U.S. Pat. No. 5,017,905 to S. Yuchi entitled FIRE ALARM SYSTEM provides a system including a plurality of addressable detectors connected to a central receiving unit or receiver. In this system, one of the addressable detectors is assigned as a group master detector to a particular area under surveillance. Also, a plurality of unaddressable slave detectors that are located within the particular surveillance area are connected to the group master detector. Thus, the system provides the capability of covering wide areas of surveillance using a relatively small number of addressable detectors.

Similarly, U.S. Pat. No. 5,117,219 to L. D. Tice, et at. entitled SMOKE AND FIRE DETECTION SYSTEM COMMUNICATION provides a system having a central controller that transmits data to remote smoke/fire detectors and modules, using pulse code modulation, and the remote detectors and sensors communicate with the controller by pulse width modulated current pulses. Each module is further connected to a peripheral device, such as a sounder, strobe, door closer or water flow switch.

It is further known that fire detectors may also perform calculations to determine the likelihood of a fire related condition. For example, U.S. Pat. No. 5,267,180 to Y. Okayama entitled FIRE ALARM SYSTEM HAVING PRESTORED FIRE LIKELIHOOD RATIO FUNCTIONS FOR RESPECTIVE FIRE RELATED PHENOMENA provides a system having a plurality of fire detectors connected to a fire receiver for detecting at least one fire related condition, such as temperature level, smoke density or gas concentration of a particular surveillance area. Collected information or data inclusive of environmental data of fire related conditions are applied to a respective fire likelihood ratio function and processed by the system in order to improve the accuracy of decision making with respect to fire conditions.

However, such intelligent transponders of the prior art have very limited features due to the wide variety of different types of devices that may be controlled by the intelligent transponders. Since the different types of devices have a finite number of common features, the intelligent transponder features are limited to those common features.

Electronic addressing is one type of feature that saves installation time and improves the system reliability of an intelligent transponder by eliminating the inherent problems associated with mechanical configuration switches, such as dip switches and rotary dials. The present invention provides a module-based system having the ability to electronically assign and download the modules' "personalities", thereby to select a variety of functions for the modules. In this manner, the programmable "personalities" enable devices and circuits controlled by the modules to operate in multiple ways without the need to adjust dip switches or jumpers. Each individual personality is downloaded to set a device's function as, for example, a supervisory, waterflow, alarm verified momentary, or latching function. Thus, the particular electronic addressing and controlling feature of the present invention provides ease and reliability of installation and modification of an alarm system.

Against the foregoing background, it is a primary object of the present invention to provide an alarm system for detecting and warning of the presence of alarm and trouble conditions in a plurality of zones that includes in each zone, as one example, a field programmable, universal module having the flexibility to change functions or personalities upon receipt of software configuration commands from an alarm loop controller.

It is another object of the present invention to provide a field programmable module having changeable personalities in order to accommodate and control a wide variety of different types of devices connected to the module without being limited to the common features of a given device.

It is a further object of the present invention to provide such a field programmable, module to provide an easy and inexpensive method of modifying the function or personality of the module.

It is still further object of the present invention to provide a field programmable, universal module that can be used as a spare module to replace a wide variety of different types of modules of the alarm system that may cease to function properly.

It is still another object of the present invention to provide such a field programmable, universal module such that the universal module has the ability to electronically receive a personality code downloaded locally, or from the control panel, to select its function and provide ease and reliability of installation and modification of the alarm system.

SUMMARY OF THE INVENTION

Before getting into the summary of the invention, it is well to consider the following definitions:

A module when referred to hereinafter is an electronic circuit that is interconnected over the same wire pair as smoke detectors. Thus, in the system which forms the context of the present invention, modules have been incorporated in each of the units located at various zones or stations of the system, and these modules are connected over the same wire pair as the smoke detectors or other sensing devices at the given station. Smoke detectors monitor particles of combustion while the modules themselves monitor external contact closure activity in connection with the outbreak of fire or the like, and these are such as the following: heat detectors, fire alarm pull stations, door closures, fan shutdown, audible and visual signal devices, etc.

Modules and smoke detectors of an alarm system may be connected to an alarm control panel through a spur loop or a ring loop. A spur loop is a linear design concept whereby one end of a line of modules and smoke detectors is connected to the control panel whereas the other end has an end of line terminator. In contrast, both ends of a line of modules and smoke detectors for a ring loop are connected to the control panel. For fire alarm systems, spur loops are designated as class B type and ring loops are designated as class A type. The present invention is capable of accommodating both class A type and class B type of arrangements.

A primary feature of the present invention resides in a system of interconnection controlling, intelligent modules having respective, integral microcontrollers, so that a central loop controller is not tied up with simple and mundane tasks. An intelligent module uses its on electronic circuitry to perform many functions that cannot be completed by a convention "dumb" device which relies upon the loop controller for all of its operating instructions. However, for situations where replacement of conventional "dumb" devices with intelligent devices would be cost prohibitive or otherwise difficult, there is a need for connecting such conventional devices to the loop controller along with the intelligent devices of the system. Thus, one of the benefits of distributed intelligence systems, and in particular intelligent modules, is the advantages of an addressable system of intelligent devices in addition to the advantages received from conventional hard-wired systems.

As a result, the programmable personalities of the present invention provide the flexibility of changeable functions due to the changeable personalities available, upon receipt of software configuration commands from a loop controller, for connecting and controlling conventional devices within a distributed intelligence system.

To accomplish the foregoing objects and advantages, the present invention, in brief summary, is an alarm system for detecting and warning of the presence of various conditions by means of transponders in a plurality of zones comprising: a loop controller having a plurality of supply lines extending to the transponders; a module, within each of the transponders, connected to the plurality of supply lines, the module being capable of initiating communication of the conditions in its respective zone to the loop controller; and means for variably determining specific different personalities of the module such that the module functions selectively in a variety of specific ways, wherein the means for variably determining includes means for selectively storing specific configuration data in the module to define the respective specific personalities; a plurality of device containing circuits coupled to the module; and means, responsive to the storage of specific configuration data, for selecting respective modes of operation for the circuits.

Other and further objects, advantages and features of the present invention will be understood by reference to the following specification in conjunction with the annexed drawings, wherein like parts have been given like numbers.

BRIEF DESCRIPTION OF THE DRAWINGS

The foregoing and still further the objects and advantages of the present invention will be more apparent from the following detailed explanation of the preferred embodiments of the invention in connection with the accompanying drawings.

DETAILED DESCRIPTION OF THE PREFERRED EMBODIMENT

Figure 1:
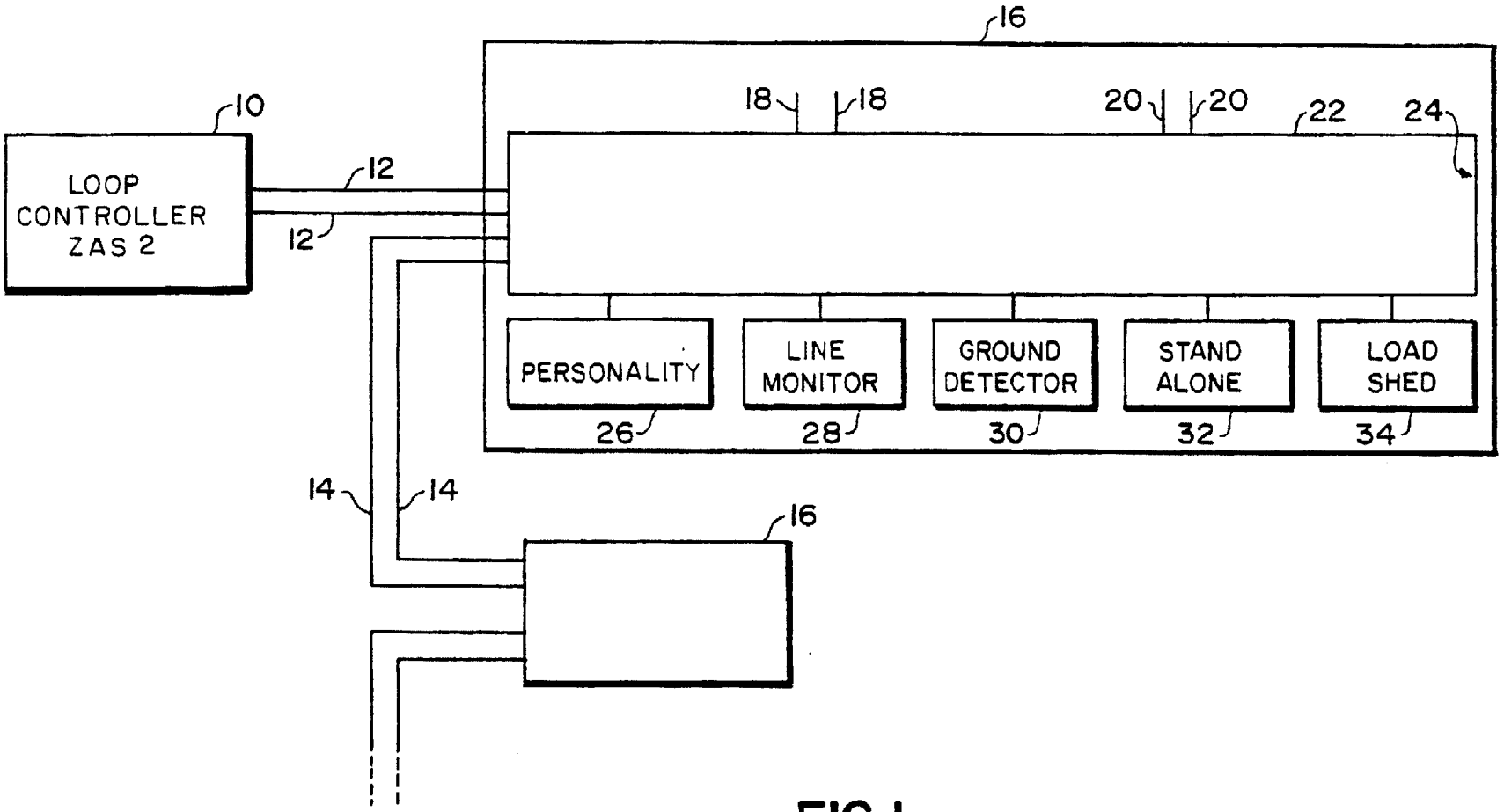
FIG. 1 is a block diagram which provides an simplified overview of the alarm system, having particular modules embodied, in which the present invention is incorporated, including transponder units.

Referring to the drawings and, in particular, to FIG. 1, there is provided a simplified showing of the system context in which the present invention operates in order to provide, as one example, a field programmable, universal module having the flexibility to change functions or personalities as described below.

System and Common Module Circuitry

Referring to FIG. 1, there is provided a loop controller of the preferred embodiment which is generally represented by reference numeral 10. The loop controller 10 is connected by multiple-wire outgoing and return cable 12 to a first transponder unit 16 which, in turn, is connected by a multiple-wire cable 14 to the next transponder unit 16 and so on to other units.

Within the first transponder unit 16, there are seen a block designated 22 representing common components of a module 24 whose inputs/outputs are represented by pairs of lines 18 and 20, which may be supplied with 24 volts D.C. and can be variously connected by selective control of the module to provide different modes of operation for the transponder unit 16.

Also seen connected to the lower part of the module 24 are the several inventive features integrally embedded in the module circuitry, namely a personality feature 26, line monitor feature 28, ground detector feature 30, "stand alone" feature 32 and "load shed" feature 32.

The personality feature 26 is the feature herein described and claimed, which involves selective programming of a microcontroller, which forms the centerpiece of the module 24, such that various prescribed functions or operations can be realized by-the given module depending on the configuration code chosen. The line monitor feature 28 is described and claimed in co-pending U.S. patent application Ser. No. 08/441,754 (Docket No. 100.0602) which is incorporated herein by reference. Similarly, the ground detector feature 30 is described and claimed in U.S. patent application Ser. No. 08/441,811 now U.S. Pat. No. 5,644,293, the stand alone feature 32 is described and claimed in co-pending U.S. patent application Ser. No. 08/441,803 and the load shedding feature 34 is described and claimed in co-pending U.S. patent application Ser. No. 08/441,762. The details of the disclosures of all of the preceding are incorporated herein by reference to the related patent applications already noted.

Figure 2:
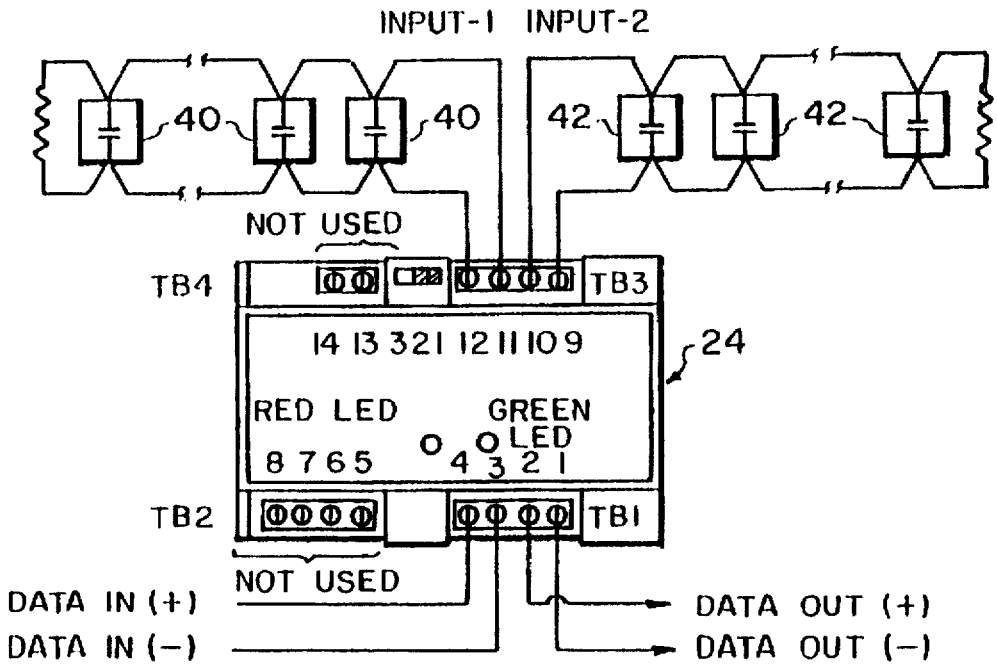
FIG. 2 is a block-schematic diagram of a class B dual input arrangement for a universal module with particular input circuits depicted therefor and incorporating the present invention.

Referring to FIG. 2, there is depicted the module 24, which is a universal module, and can be arranged, in one example, to operate class B as a dual input module. Moreover, in this figure, connections of "data in" lines and "data out" lines are seen made to terminal blocks at the bottom of the modules, these lines corresponding, respectively, to lines 12 and 14 in FIG. 1. However, what is not seen in FIG. 1, are the particular class B input connections which are effectuated by the switch contacts 40 in input circuit 1 and the contacts 42 in input circuit 2.

Figure 3:
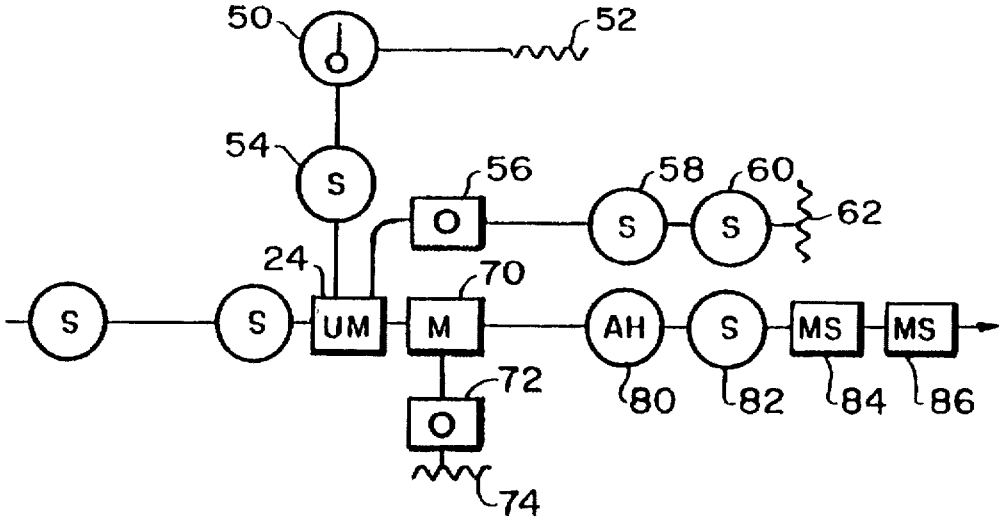
FIG. 3 is a block diagram of part of a general alarm system that includes the universal module of FIG. 1, and particularly illustrates a variety of devices in the form of smoke detectors and other units connected at a given zone or station corresponding to the universal module.

FIG. 3 illustrates the system, where focus is on the selected circuitry or circuit pathways extending from the universal module 24 which, as previously discussed, is part of a transponder unit 16 located at a given zone or station. The module 24 is depicted in association with a variety of devices in, for example, input circuits. Such devices can be selected as a package with such universal module 24, or the module can be incorporated into an already existing system, that is, retrofitted to an older style system to bring it up-to-date. Thus, as shown in FIG. 3, two loops extend from the upper portion of the module. One loop includes a heat detector 50, an end of line resistor 52 and a conventional smoke detector 54. In the other loop, there is a manual station 56, and two conventional smoke detectors 58, 60 with an end of line resistor 62 for that other loop.

Also connected to the universal module 24 is a plurality of intelligent devices, including a monitor module 70 and its associated "dumb" devices, namely a manual station 72 and an end of loop resistor 74. Also, an intelligent analog heat detector 80, an intelligent analog smoke detector 82, analog manual stations 84 and 86 extending further down the loop from the universal module 24 beyond the aforenoted monitor module 70.

The Universal Module and the Personality Feature

Figure 4A:
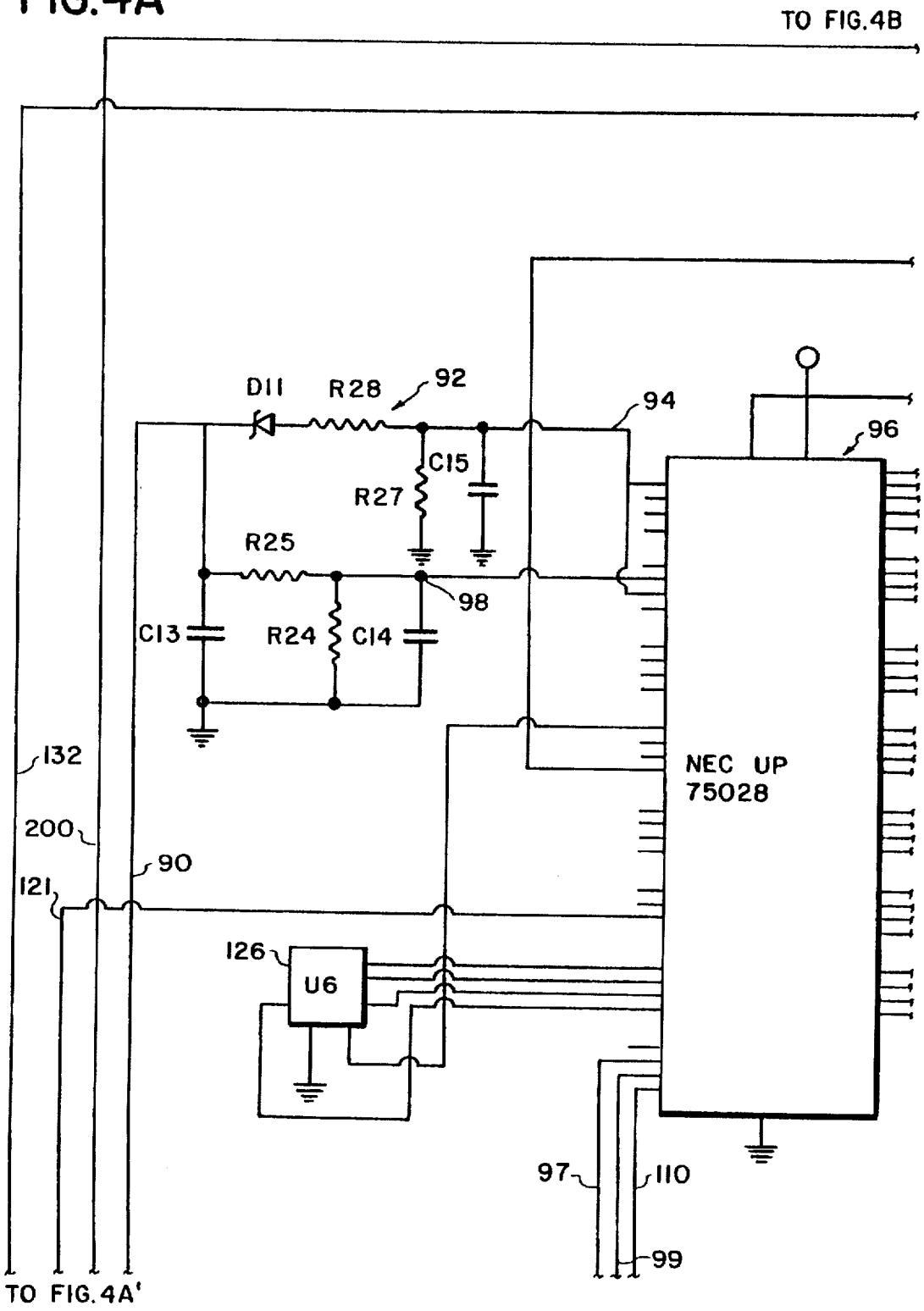
FIGS. 4A–D and 4A'–C' together form a schematic diagram of the universal module of FIG. 1.
Figure 4B:
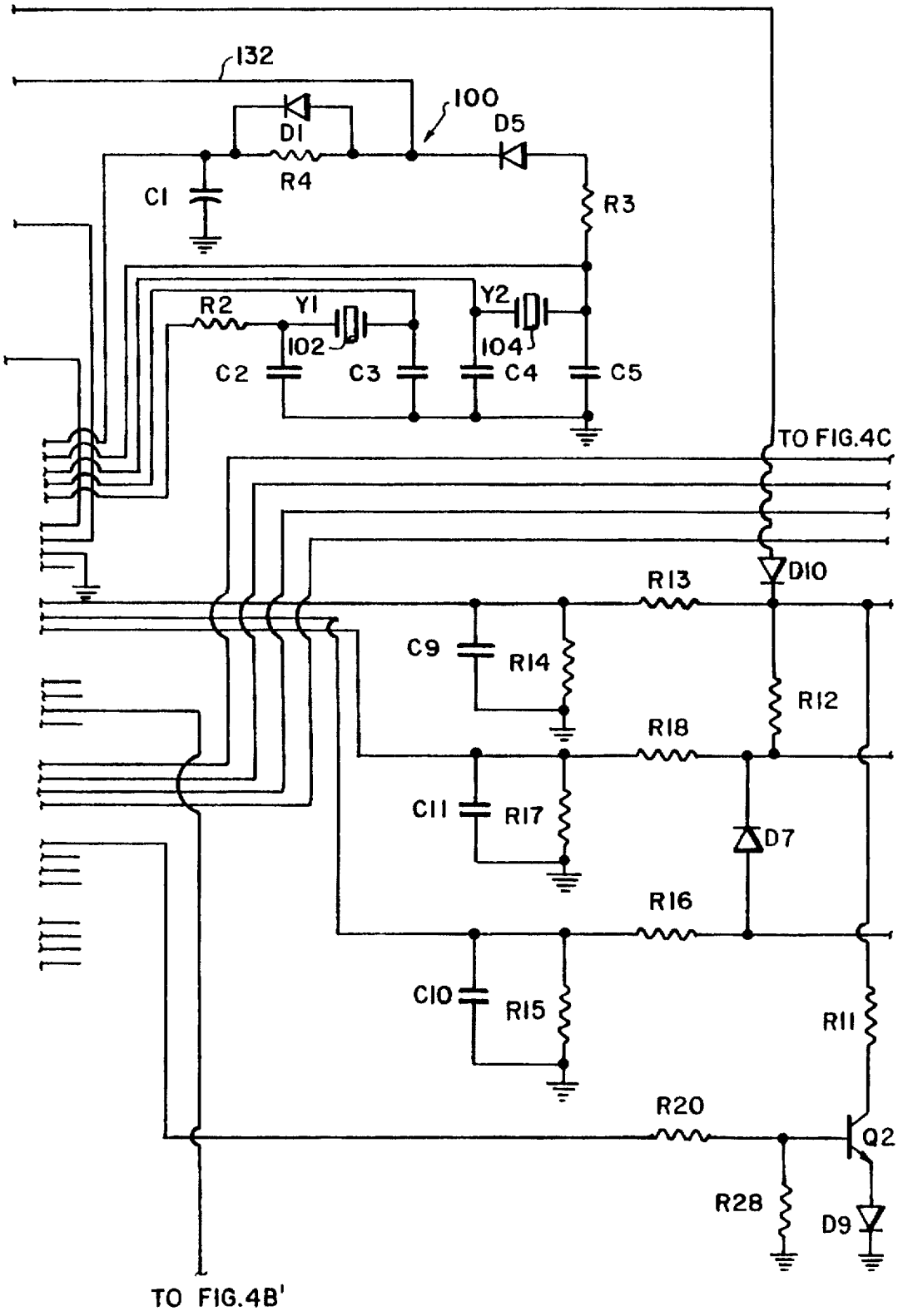
Figure 4C:
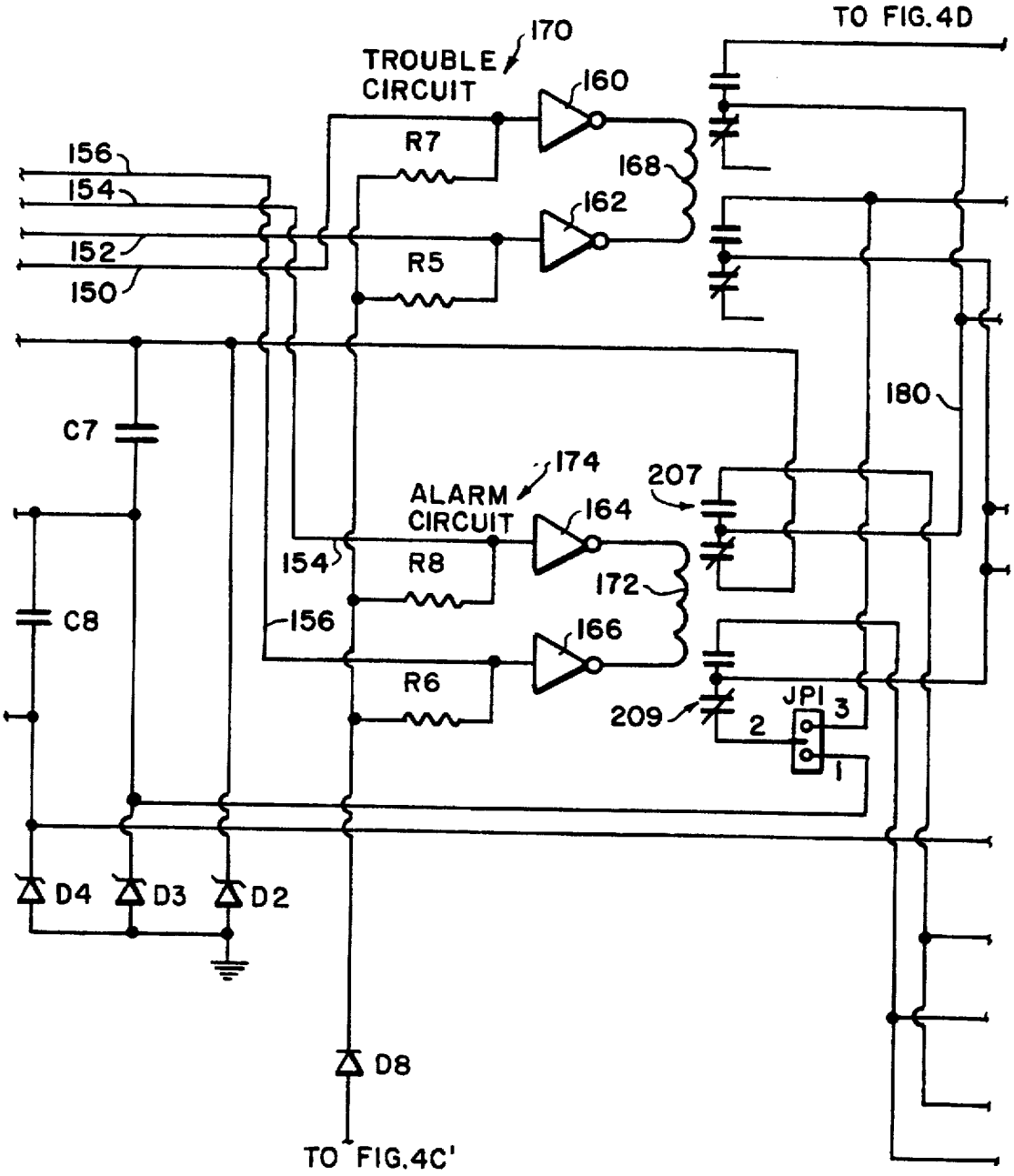
Figure 4D:
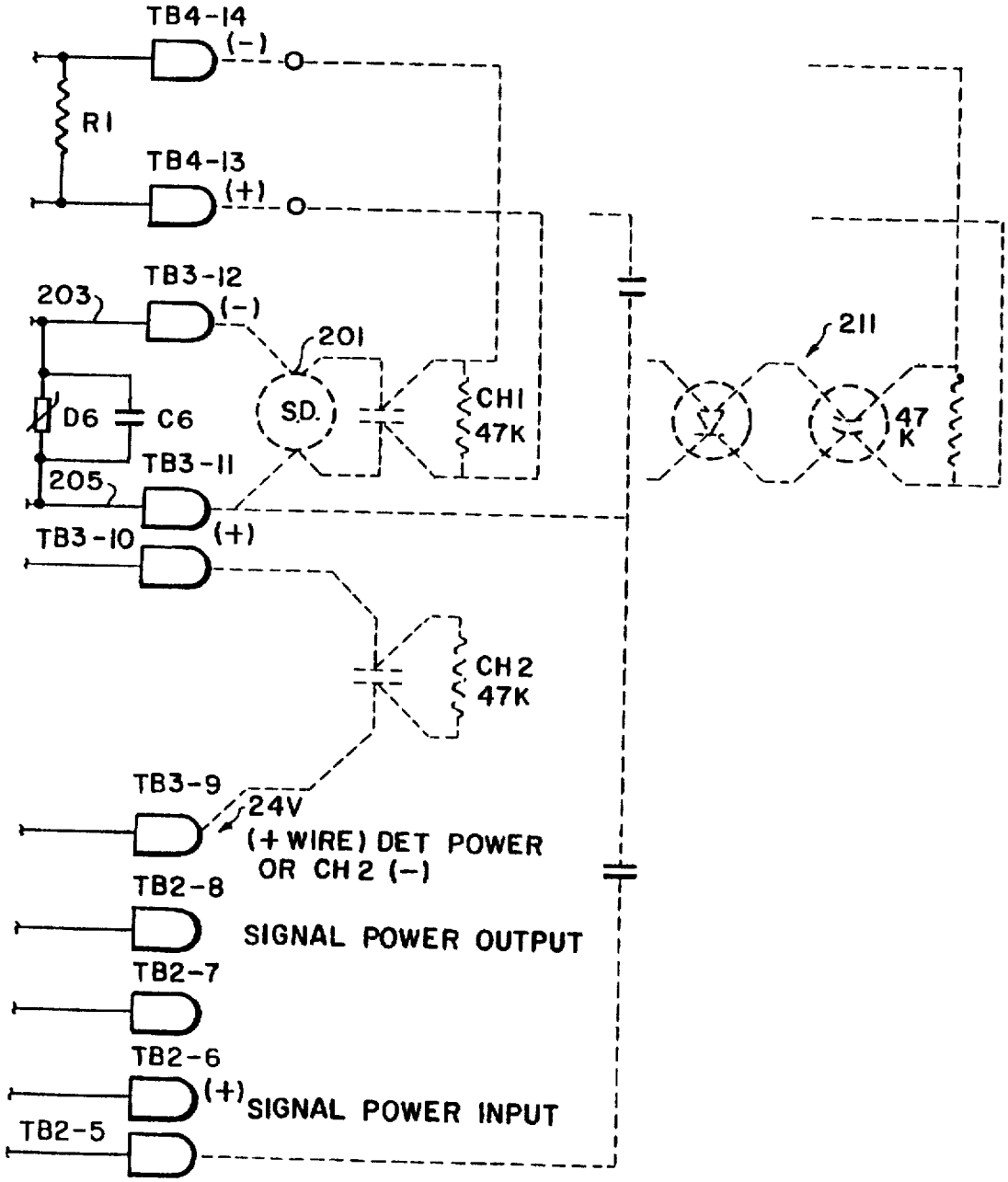
Figure 4A:
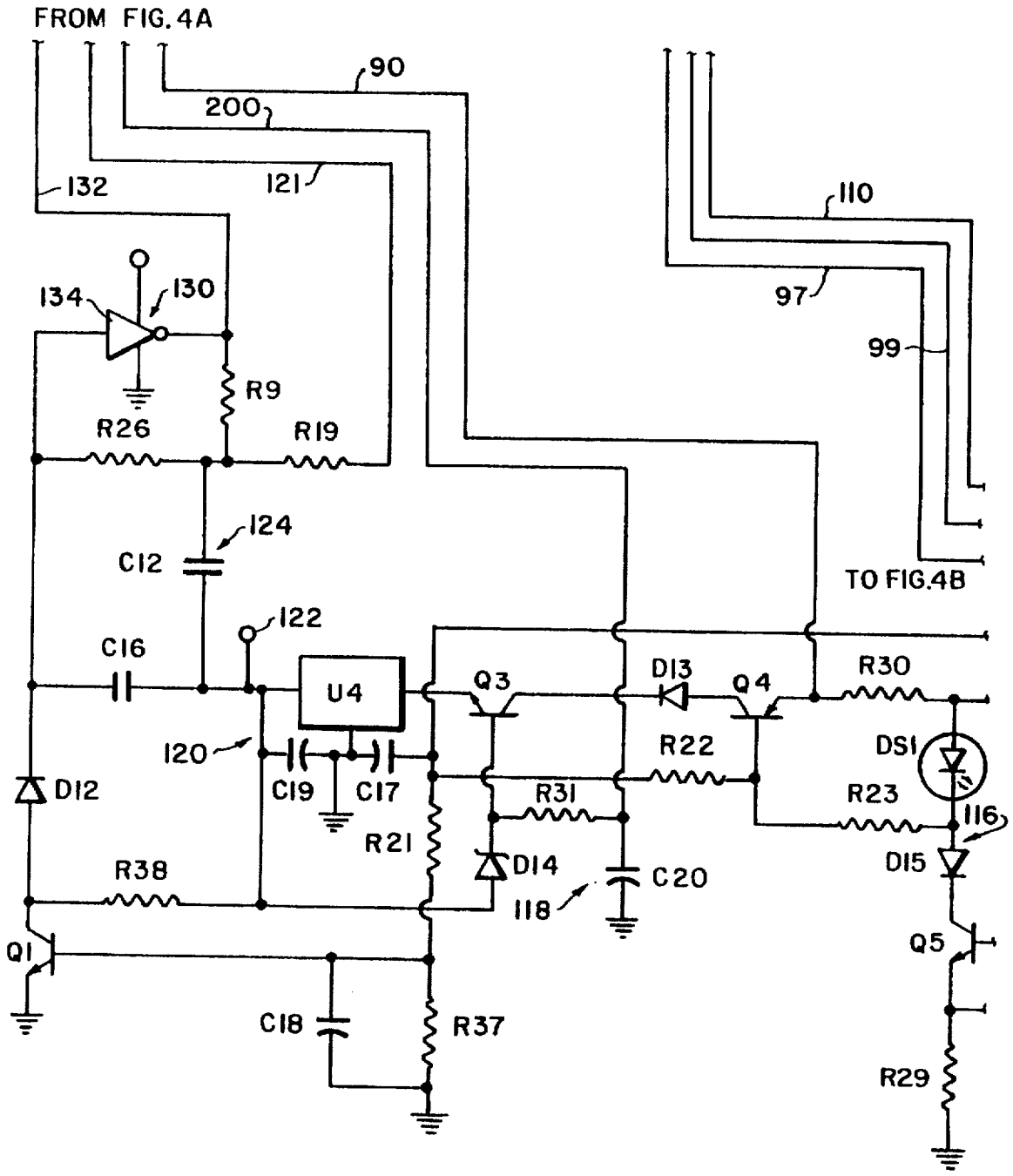
Figure 4B:
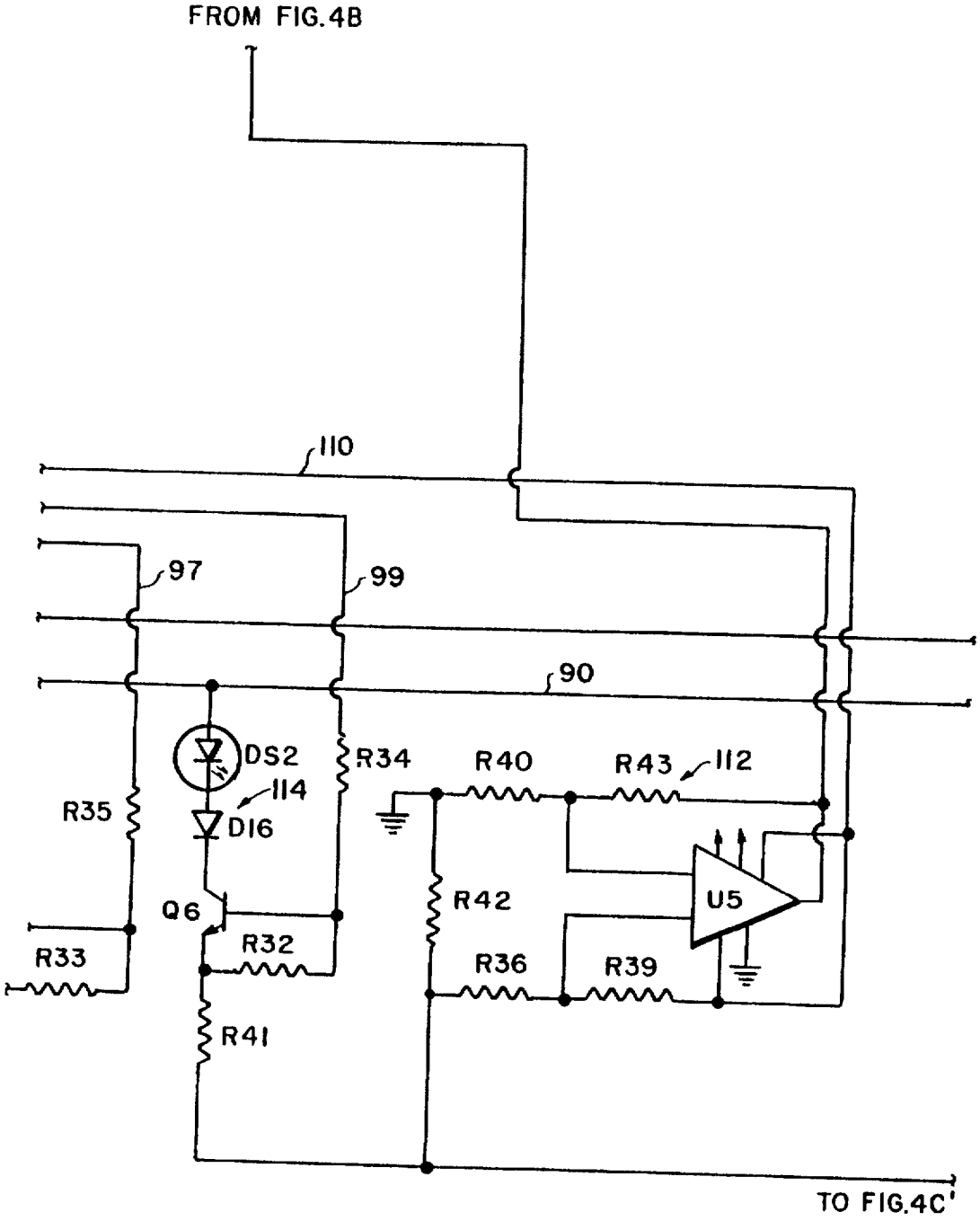
Figure 4C:
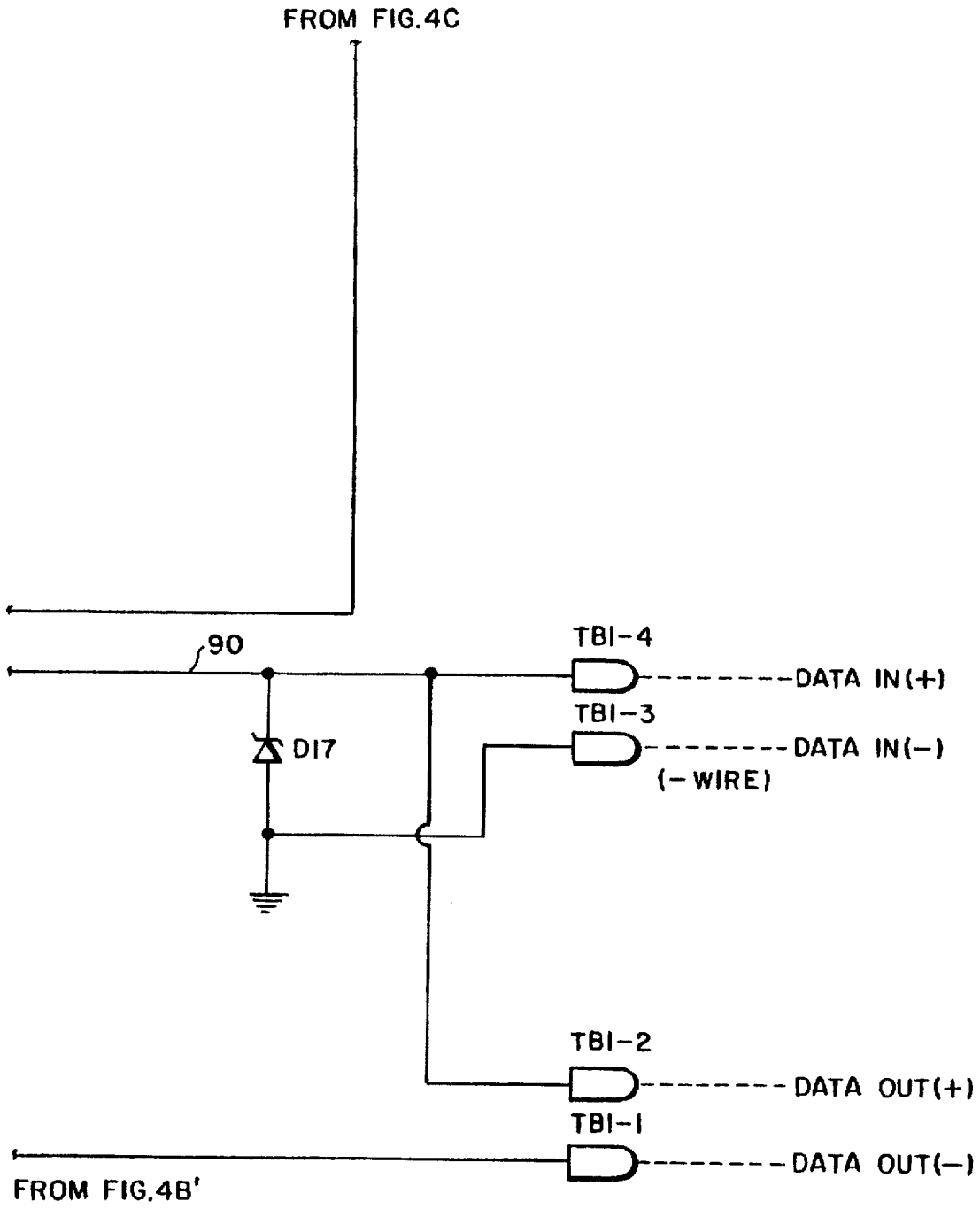

FIGS. 4A through 4D and 4A' through 4C' are combined to form a schematic diagram of a transponder in which a universal module 24 having the personality feature is embodied. To be considered first are the common aspects of such module 24. Referring specifically to FIG. 4C', the module circuitry has terminals, designated TB1-3 and TB1-4, connecting to the previous transponder, or directly to the loop controller, for receiving data from the loop controller, designated TB1-3 and TB1-4. Similarly, the module circuitry has terminals designated TB1-1 and TB1-2 that are connected to the next device.

It will be appreciated that data communication is accomplished over the aforesaid lines, as well as synchronous power transmission. As one example, interrupt signals from the loop controller 10 are transmitted to the module 24 of the first transponder unit 16 over the "data in" lines (designated 12 in FIG. 1); three levels of interrupter command voltages being available that can be transmitted from the loop controller. For the preferred embodiment, these three levels of voltages are zero volts, 9 volts, and 19 volts. These voltages are sent by way of connection 90 from terminal TB1-4 in FIG. 4C' (through FIGS. 4B' and 4A') to a discriminator circuit 92 in FIG. 4A.

Figure 5:
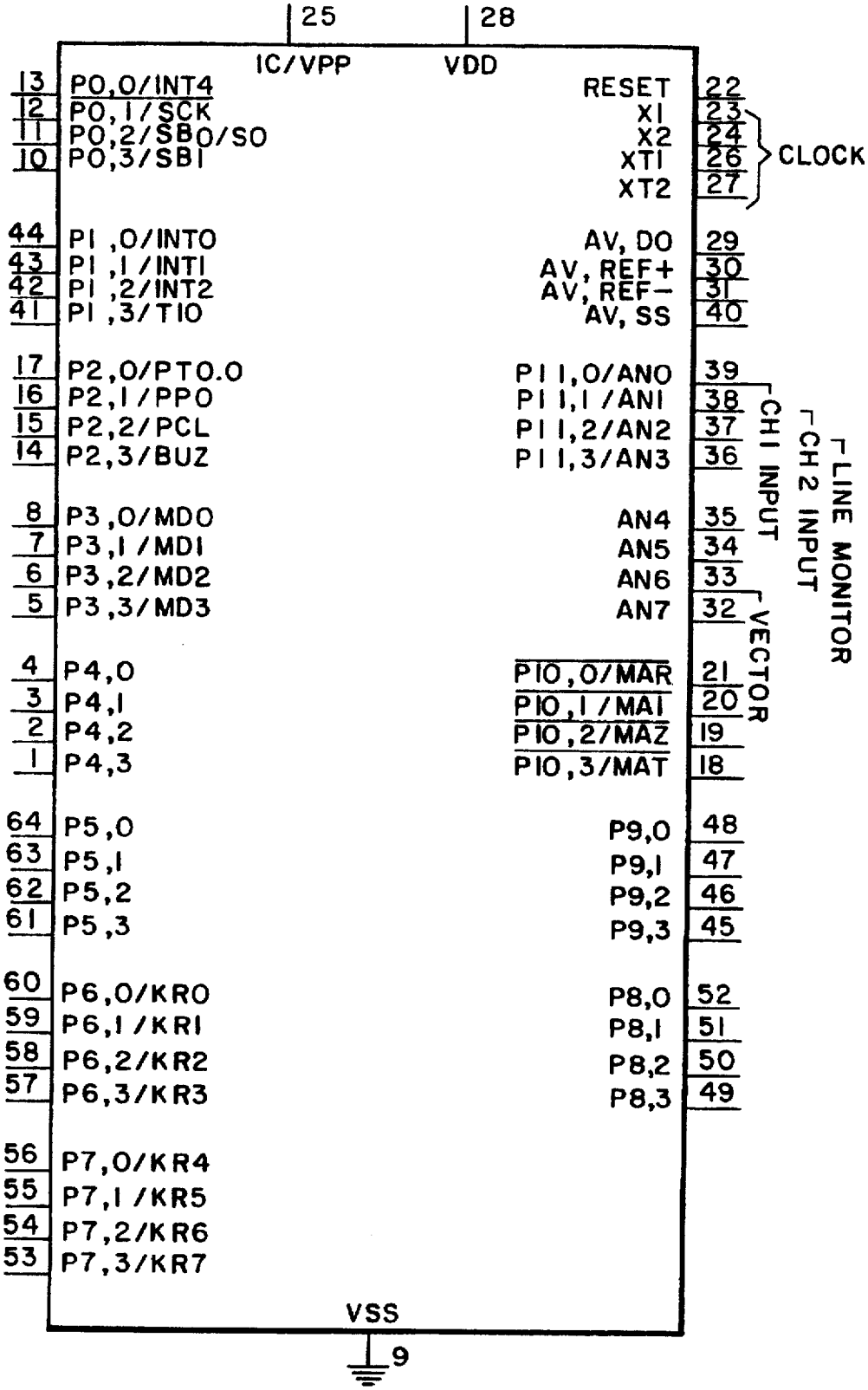
FIG. 5 is a magnified view of the microcontroller of the universal module of FIG. 4A.

Referring to FIG. 4A and 5, the discriminator circuit 92 has two output nodes represented by reference numerals 94 and 98. Node 94 is connected to inputs or terminals "13" and "42" of the microcontroller 96. Likewise, node 98 is connected to input or terminal "43" of the microcontroller 96. The discriminator circuit 92 produces a binary output for these three terminals, particularly for terminals "13" and "43", that is based on the three levels of voltages coming in through connection 90.

For the preferred embodiment, this microcontroller 96 is selected to have an NEC microprocessor, model no. 75028, therein as well as an EEPROM 126 manufactured by EXCEL. Although the functions of the functions of the EEPROM 126 may be implemented within the microcontroller 96, the EEPROM is separate from the microcontroller for the preferred embodiment. The EEPROM 126 is a 512 bit non-volatile memory that is strobed from terminal "8" of the microcontroller for low power consumption. Referring to FIGS. 4A and 5, a group of four input or output ports is connected by respective terminals "57" through "60" to terminals of a 64 bit register in EEPROM 126. The connection from terminal "8" of the microcontroller 96 to the EEPROM 126 is made for the purpose of providing a "strobe" to the EEPROM when it is necessary to read the units identifying a particular number stored in one of the EEPROM's registers.

It should be noted that the microcontroller 96 is the centerpiece or control center of the module 24 and its input and output ports are connected to a variety of circuits within the module. For all references to the schematic of FIGS. 4A through 4D and 4A' through 4C', particularly references to terminal or pin connections, reference should also be made to the magnified view of microcontroller 96 shown in FIG. 5. Thus, referring to FIGS. 4A, 4B and 5, a number of input and output ports are shown on each side of the microcontroller 96, as well as connections made to the top and bottom thereof. A ground connection is made at the bottom of the microcontroller 96 at terminal "9" and a bias connection (3.3 volts) at the top at terminals "25" and "28", as well as a connection to terminal "29" on the right side of the microcontroller.

A group of terminals "22" through "27" are provided for reset and for timing control of the microcontroller, the timing control connection being made to a timing or block circuit 100, provided with two clocks 102 and 104.

A group of other terminals are used for reference and average bias manual connections, such being seen as connected to terminals "29", "30", "31" and "40". In turn, the terminal "29" is connected to the 3.3 volt bias, "30" is connected to an input or output port at terminal "5", and "31" and "40" are connected to ground.

A group of analog/digital ports are connected to the terminals designated "36" through "39", and another group of analog/digital ports are connected to the terminals designated "32" through "35" of the microcontroller 96.

A further group of terminals are connected to input or output ports of microcontroller 96, which are, in turn, connected to relay cards for purposes to be explained. Another terminal on the right of the microcontroller a "loadshed 1" line to terminal "48" for purposes to be explained in connection with a load shed feature in accordance with a related invention.

Other groups of terminals, connected with output ports, appearing on the left of the microcontroller 96 are the group of terminals "53" through "55" shown in FIG. 4A connected to circuitry shown in FIG. 4B'. These output ports provide communication back to the main or control panel, terminal "53" being connected by the connecting means 110 to the output of circuit 112 at the bottom of the figure and, hence, terminal "53" connects to an input port of the microcontroller 96. Terminals "54" and "55" connect to individual circuits 114 and 116 which are LED circuits that illuminate green and red LED's, respectively, at appropriate times. For example, an alarm signal is to be sent to the loop controller 10 by way of an output port, i.e., terminal "55" on the microcontroller 96, to the input of a transistor Q5 by a connection means 97. This results in conduction of the transistor Q5 and turn on of the red LED in circuit 116. Similarly, a trouble signal is sent to the loop controller 10 by way of terminal "54" on the microcontroller 96 to the input of a transistor Q6 by a connection means 99 and, thus, results in conduction of the transistor Q6 and turn on of the green LED in circuit 114. The further consequence of sending the alarm signal or the trouble signal is a constant current response pulse on the data lines 12.

Further portions of the circuitry involve a peak detector 118 and a bias circuit 120 which as can be seen by the node 122 which supplies the bias of 3.3 volts for the microcontroller 96. A watchdog circuit 124 is seen immediately above the bias circuit 120, having a connection to the microcontroller 96 at terminal "62".

A reset circuit 130 furnishes a Reset + signal by way of the connection 132 to the clock circuit 100, the amplifier 134 in such circuit being biased from the 3.3 volts supply from node 122.

It will be noted that terminals "18", "19", "20", "21" of microcontroller 96 extend by means of connections 150, 152, 154, 156, respectively, to respective operational amplifiers, 160, 162, 164, and 166. The former two operational amplifiers 160, 162 are connected to respective ends of coil 168 to form trouble circuit 170. Similarly, an alarm circuit 174 is defined by the latter two operational amplifiers 164, 166 that are connected to opposite ends of relay coil 172. Either the trouble circuit 170 or the alarm circuit 174 can be operated in class B, and both circuits can be operated in class A, if desired. Each of the relays in the trouble and alarm circuits 170, 174 are double-pole, double throw types, each involving four relay contacts. As shown in FIG. 4C, two relay contacts are open and two relay contacts are shown closed for the trouble circuit 170 and the alarm circuit 174.

Referring to FIGS. 4A through 4D and FIG. 5, terminals "18" through "21" of the microcontroller 96 controls the relay contacts of the trouble circuit 170 and the alarm circuit 174 provide appropriate output signals to devices connected to terminal contacts 5 through 7 (TB2-5 through TB2-8), terminal contacts 9 through 12 (TB3-9 through TB3-12) and terminal contacts 13 and 14 (TB4-13 and TB4-14). Likewise, terminals "37" through "39" of the microcontroller 96 receive input signals from the devices connected to terminal contacts 5 through 14. Thus, microcontroller 96 is capable of transmitting and receiving a wide variety of signals to and from devices that are connected to terminal contacts 5 through 14.

The universal module 24 of the present invention can be set to a particular function or personality from a remote location, such as from the loop controller 10, by downloading one of many different personality codes into a memory portion of the module. For the preferred embodiment, as shown in FIGS. 4A through 4D and 4A' through 4C', the particular personality code is downloaded from the loop controller 10 and received by the universal module 24 at terminals TB1-3 and TB1-4. Through terminal TB1-4 in particular, the particular personality code travels along connection 90 from FIG. 4C' to FIG. 4A to be received by the discriminator circuit 92.

Microcontroller 96 receives the particular personality code from the discriminator circuit 92 through terminals "13" and "43" and stores the code in the EEPROM 126. In general, the microcontroller 96 transmits data, such as the personality code, to the EEPROM 126 from terminal "58" and receives data from the EEPROM at terminal "57". The EEPROM 126 has a plurality of registers to store certain types of data received from the microcontroller 96. For example, the preferred embodiment stores the particular personality code as configuration data bits in registers 3 & 4 and as label data in register 5. Also, address data for identification of the particular universal module 24 by the control panel 10 is stored in register 7.

When the universal module 24 is initially installed within the system, registers 3 and 4 of the EEPROM 126 are set to a default personality code, namely zero. After the universal module 24 receives a particular personality code from the loop controller 10 and registers 3 and 4 of the EEPROM 126 are set, as described above, microcontroller 96 will thereafter communicate with any devices connected to terminal contacts 5 through 15 based on the particular personality code. For example, personality code #1 would inform microcontroller 96 to configure and communicate with either one or both class B type loops connected to terminal connections 9 through 12 for normally open dry contact initiating devices such as pull stations, heat detectors, etc. Consequently, an alarm signal is sent to the loop controller 10 when an input contact is closed and, thus, the alarm condition is latched at the module 24. It will be understood that other personality codes assigned to registers 3 and 4 of the EEPROM 126 will provide different functions and operations as provided in Table 1 below.

TABLE 1

| Personality | Description |
|---|---|
| 01 | Class B Alarm Latching |
| 02 | Class B Alarm Latching-Delayed |
| 03 | Class B Active Non-Latching |
| 04 | Class B Active Latching |
| 05 | Riser Selector |
| 06 | Riser Selector w/ Telephone Ringtone |
| 07 | Dual Riser Selector |
| 08 | Dry Contact |
| 09 | Class A Alarm Latching |
| 10 | Class A Alarm Latching-Delayed |
| 11 | Class A Active Non-Latching |
| 12 | Class A Active Latching |
| 13 | Class B 2-wire Smoke non-verified |
| 14 | Class B 2-wire Smoke verified |
| 15 | Class A Signal Output |
| 16 | Class B Signal Output |
| 20 | Class A 2-wire Smoke non-verified |
| 21 | Class A 2-wire Smoke verified |

For the preferred embodiment, registers 3 and 4 of the EEPROM 126 each holds sixteen bits of binary data which provides more than enough room, up to thirty-two bits for the two registers, to store the particular personality code for the universal module 24. Specifically, each register stores a high byte and a low byte such that each byte has a four bit nibble, as shown below in Table 2.

TABLE 2

| Register 3: Low Byte, High Nibble | |
|---|---|
| bit 0 | Channel 2 delayed processing required. |
| bit 1 | Channel 1 configured as European Call Point. |
| bit 2 | Channel 2 configured as European Call Point. |
| bit 3 | Channel 1 configured as a latching device. |

TABLE 2-continued

| Register 3: Low Byte, Low Nibble | |
|---|---|
| bit 0 | Channel 1 analog input required. |
| bit 1 | Channel 2 analog input required. |
| bit 2 | Line Monitor analog input required. |
| bit 3 | Channel 1 delayed processing required. |
| **Register 3: High Byte, High Nibble** | |
| bit 0 | Channel 2 configured as an alarm (vs. active) device. |
| bit 1 | Channel 1 configured to inhibit alarm relay activations during shorted wire conditions. |
| bit 2 | Channel 2 configured to inhibit alarm relay activiations during shorted wire conditions. |
| bit 3 | Channel 1 configured to activate the ringtone output when the 'off-hook' condition is detected. |
| **Register 3: High Byte, Low Nibble** | |
| bit 0 | Channel 2 configured as a latching device. |
| bit 1 | Device is configured as a Class A device. |
| bit 2 | Device is configured as a 2-wire smoke device. |
| bit 3 | Channel 1 configured as an alarm (vs. active) device. |
| **Register 4: Low Byte, High Nibble** | |
| bit 0 | Device configured as a 2 channel device. |
| bit 1 | Device configured as a Hall-Effect Alarm input. |
| bit 2 | Free |
| bit 3 | Free |
| **Register 4: Low Byte, Low Nibble** | |
| bit 0 | Channel 2 configured to activate ringtone o/p when the 'off-hook' condition is detected. |
| bit 1 | Channel 1 configured as an input circuit vs. a supervisory circuit. |
| bit 2 | Channel 2 configured as an input circuit vs. a supervisory circuit. |
| bit 3 | Device configured with no output relays. |
| **Register 4: High Byte, High Nibble** | |
| bits 0–3 | Not used |
| **Register 4: High Byte, Low Nibble** | |
| bits 0–3 | Not Used |

Referring again to FIG. 2, the Class B Dual Input arrangement for the universal module 24 of the preferred embodiment can be configured to have personality code #1, #2, #3 or #4. For this arrangement, one spur loop, i.e., class B, is connected to terminal contacts 11 and 12 whereas a second spur loop is connected to terminal contacts 9 and 10. As stated above, personality code #1 configures a normally open dry contact operative in connection with initiating devices such as pull stations and heat detectors. Personality code #2 configures similar functions for initiating devices, such as waterflow alarm switches, except that the input contact is closed for a predetermined time period before an alarm signal is sent to the loop controller. Similarly, personality codes #3 and #4 operate to send an active signal, instead of an alarm signal, to the loop controller when the input contact is closed and are used for fans, dampers, doors, supervisory switches, and tamper switches.

Since personality codes #1 through #4 are configured for the Class B Dual Input arrangement, registers 3 and 4 of the EEPROM 126 may store any two of these four personality codes, one code for each spur loop. For example, one spur loop may be configured for personality code #1 whereas another spur loop may be configured for the same personality code or for one of the other three personality codes.

Thus, the personality feature of the present invention includes the ability to flexibly configure each individual loop connected to a universal module 24 having a plurality of such loops.

Figure 6:
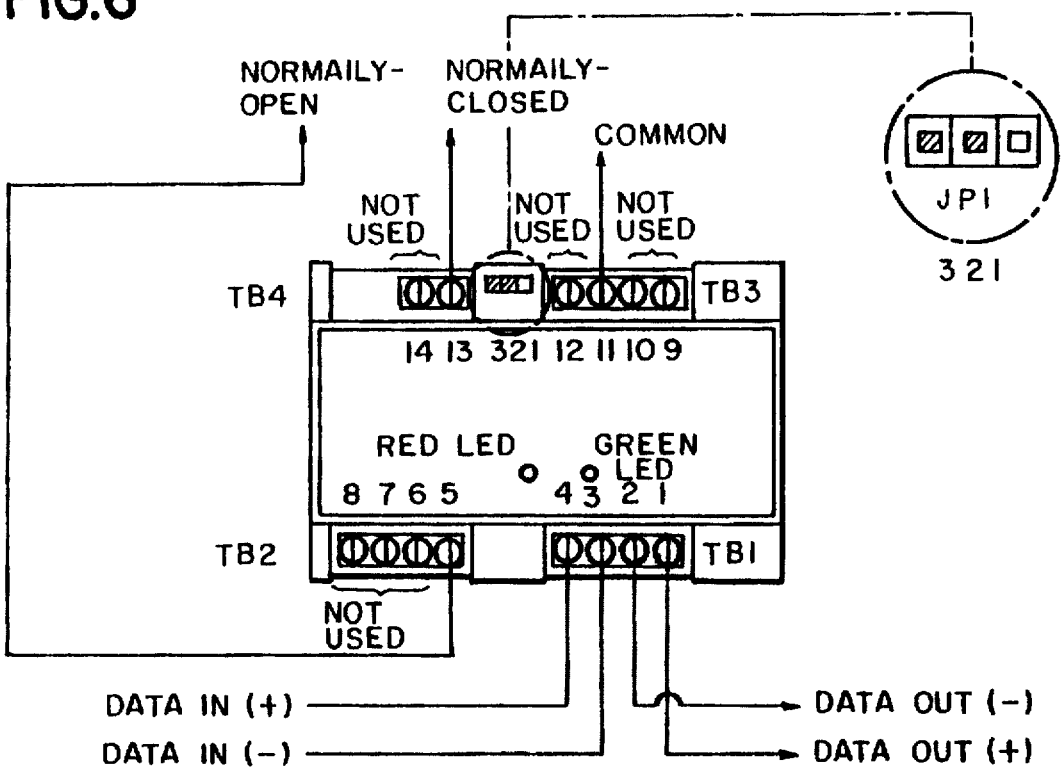
FIG. 6 is a block-schematic diagram of a control relay arrangement for the universal module of FIG. 1.

Referring to FIG. 6, there is shown a Control Relay arrangement for the universal module 24 of the preferred embodiment. This configuration for personality code #8 provides one form of "C" dry relay contact to control door closers, fans, and dampers.

Figure 7:
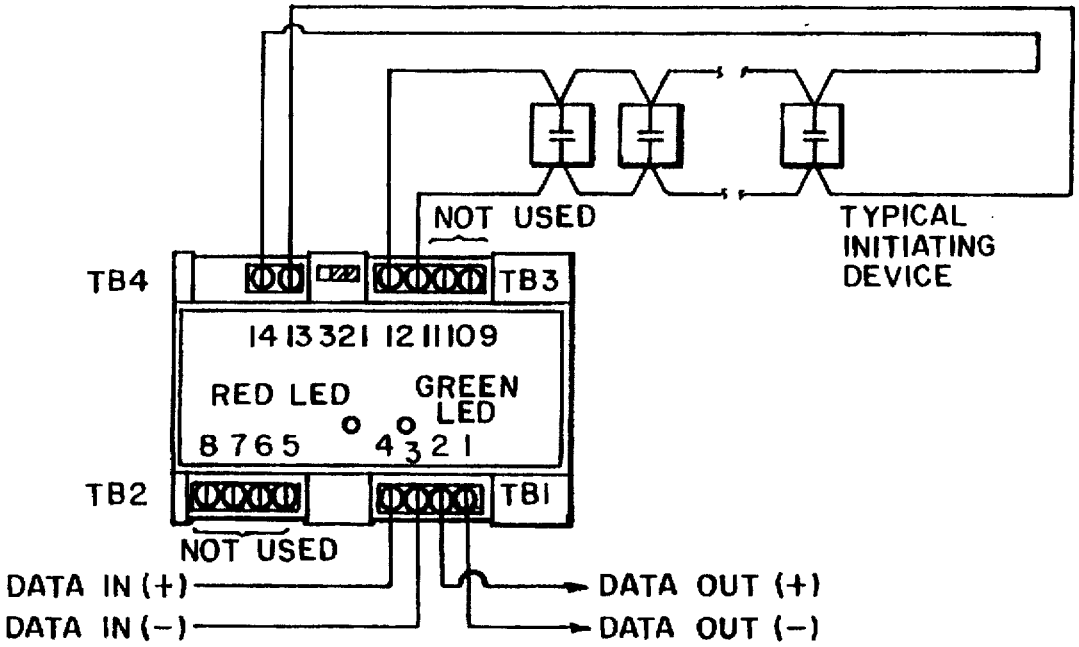
FIG. 7 is a block-schematic diagram of a class A single input arrangement for the universal module of FIG. 1.

Referring to FIG. 7, there is shown a Class A Single Input arrangement for the universal module 24 of the preferred embodiment. Personalities codes #9, #10, #11, and #12 are used for devices connected in a ring loop (class A) as shown in FIG. 7. Otherwise, this configuration is similar to the configuration of the Class B Dual Input arrangement shown in FIG. 2.

Figure 8:
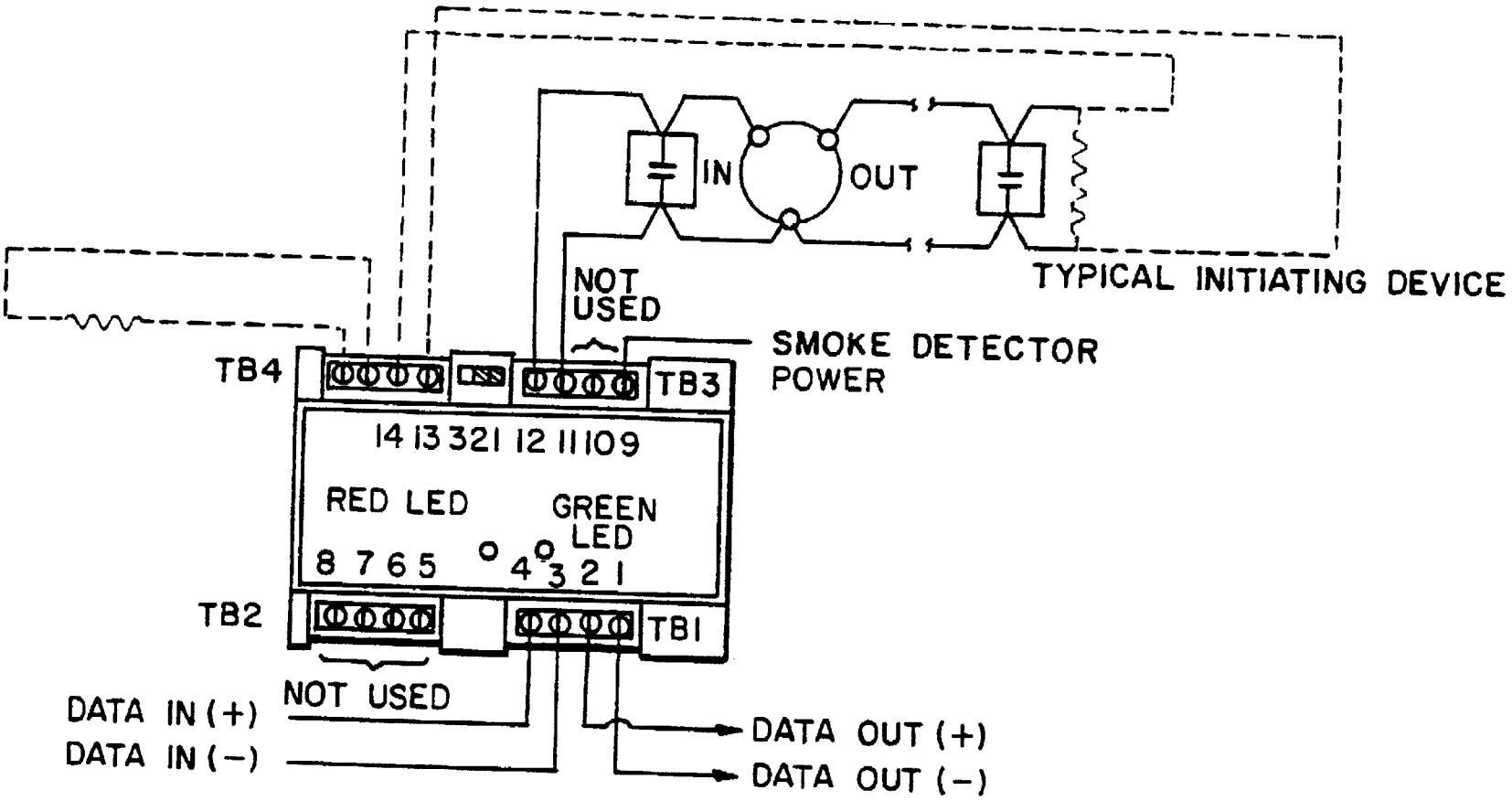
FIG. 8 is a block-schematic diagram of a 2-wire smoke detector arrangement (classes A and B) for the universal module of FIG. 1.

Referring to FIG. 8, there is shown a 2-wire Smoke Detector arrangement for either class A or class B for the universal module 24 of the preferred embodiment. For this configuration, personality codes #13, #14, #20, and #21 are used for devices connected in either a spur loop (class B) or in a ring loop (class A). In particular, the arrangement shown in FIG. 8 configures the universal module 24 for connection of conventional 2-wire smoke detectors that may or may not require alarm verification. Also, a 24 volt smoke detector power line from an external power source, such as the loop controller, extends from terminal contact 9 of the universal module 24 for use, as necessary, by other devices.

Figure 9:
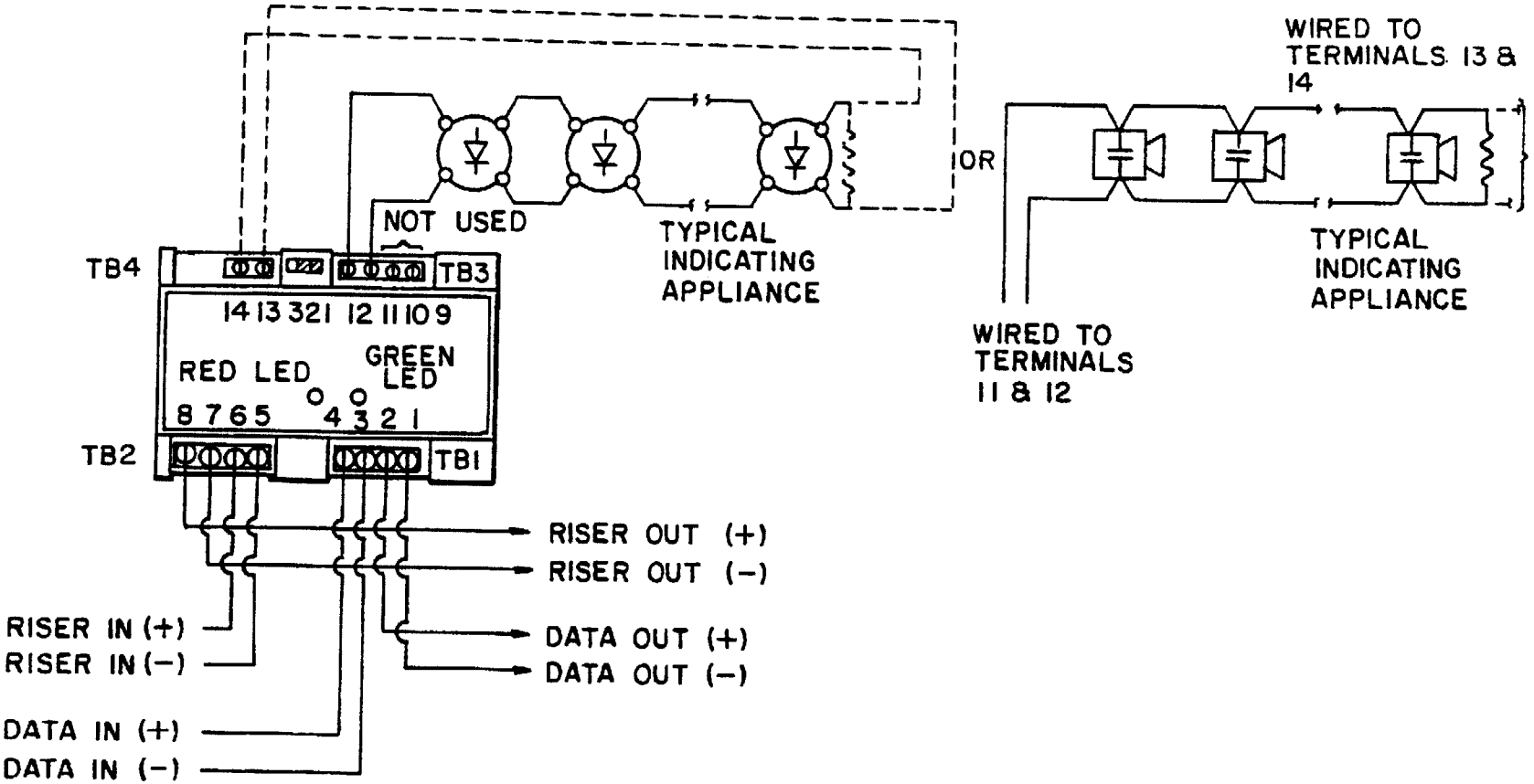
FIG. 9 is a block-schematic diagram of a single output arrangement for the universal module of FIG. 1.

Referring to FIG. 9, there is shown a Single Output arrangement for the universal module 24 of the preferred embodiment. Personality codes #15 and #16 are used to configure the universal module 24 for connection of class A or class B indicating appliance circuits. Riser In and Riser Out connections are available at terminal contacts 5 through 8 as needed by audible devices, such as bells and speakers, that are connected to the universal module 24 for this arrangement.

Figure 10:
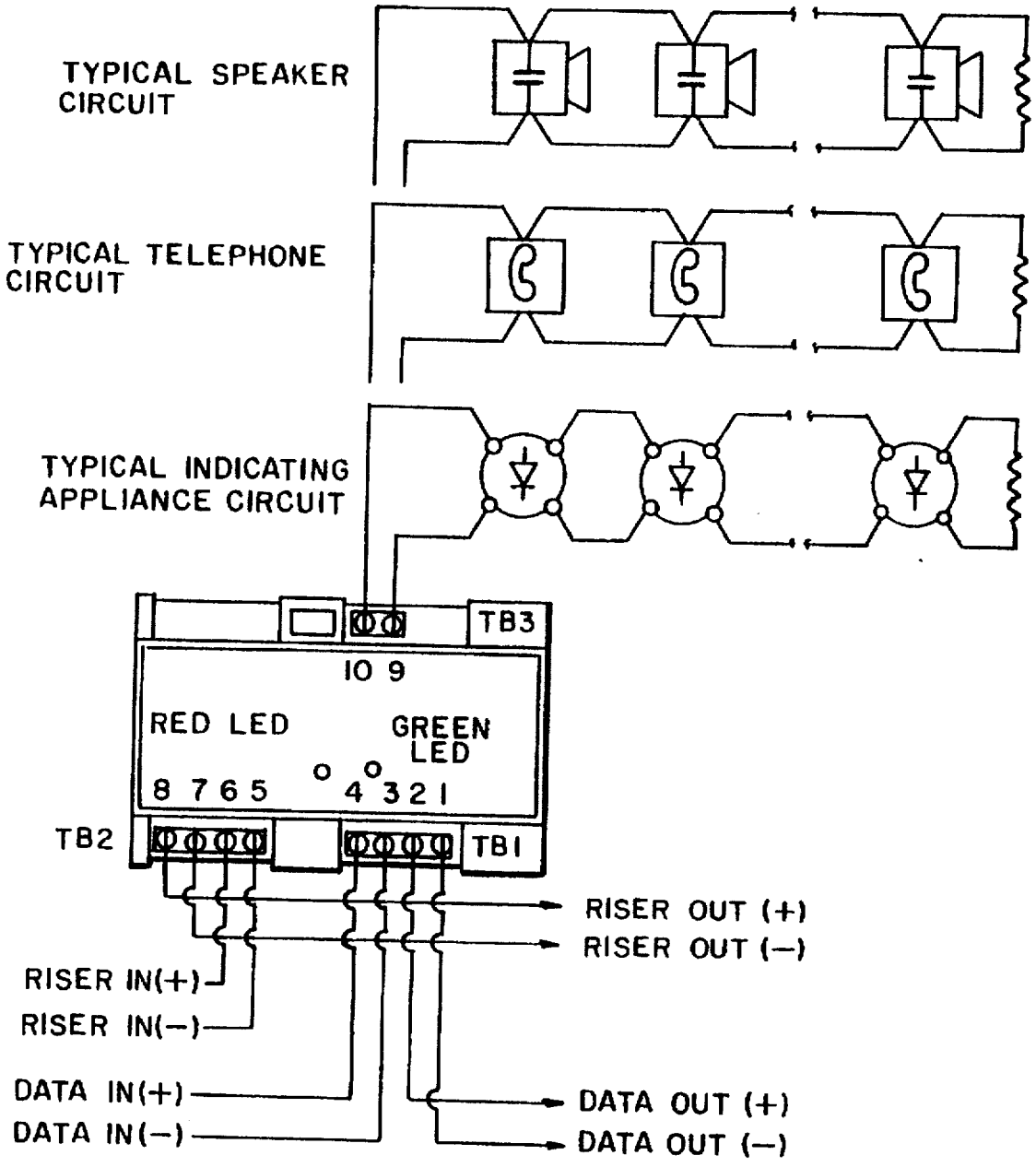
FIG. 10 is a block-schematic diagram of a single input arrangement for a first alternative universal module that incorporates the present invention.

Referring to FIG. 10, a Single Riser arrangement for the universal module 24 of the first alternative embodiment can be configured for a Signal Power or Audio Evacuation function which corresponds to personality code 5 or for Telephone with Ring-Tone function which corresponds to personality code 6.

Figure 11:
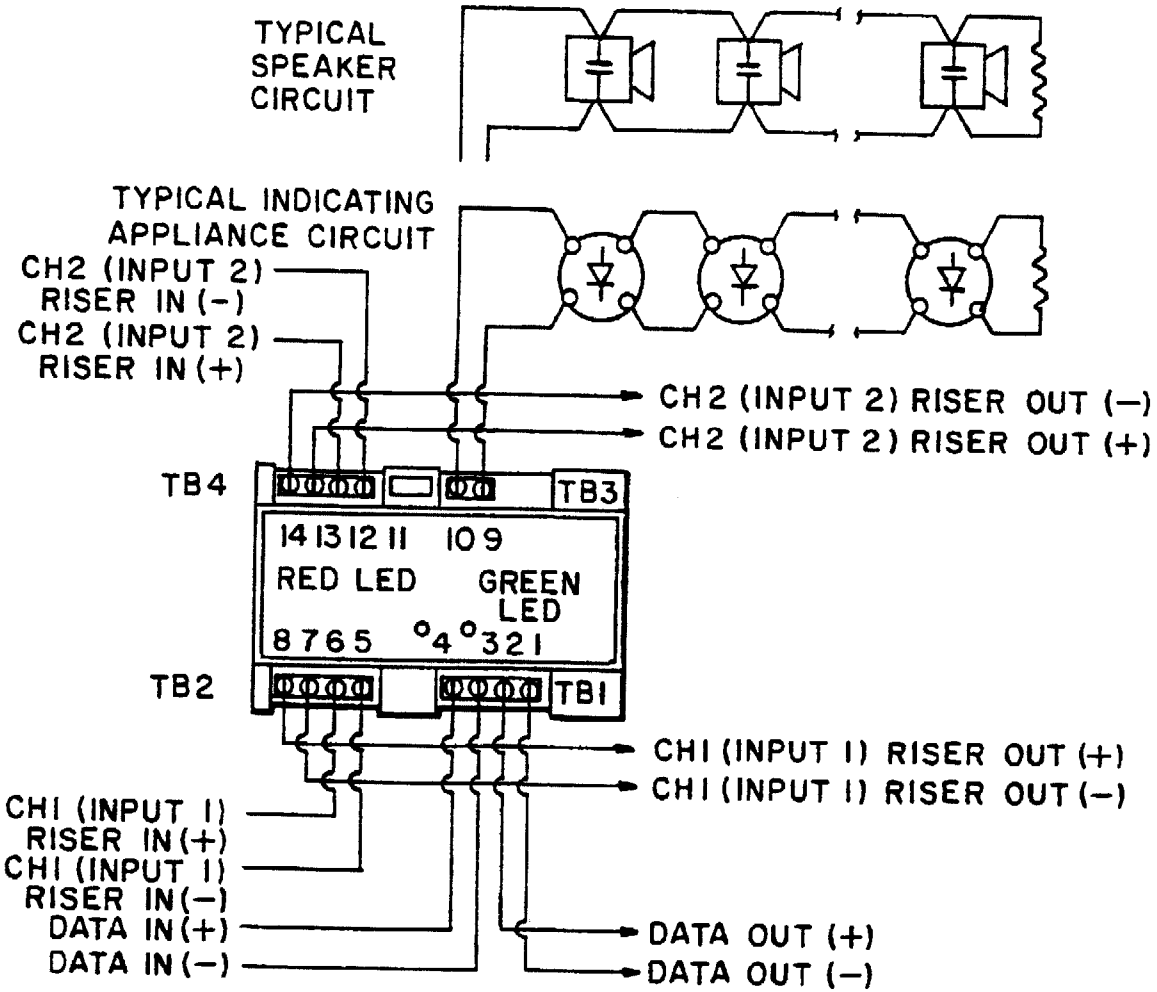
FIG. 11 is a block-schematic diagram of a dual input arrangement for a second alternative universal module that incorporates the present invention.

Referring to FIG. 11, a Dual Riser arrangement for the universal module 24 of the second alternative embodiment can be configured for a Signal Power or Audio Evacuation function which corresponds to personality code 7.

In summary, the programmable personalities of the present invention, such as the 18 personalities provided in Table 1 above, provide the flexibility of changeable functions or personalities, upon receipt of software configuration commands from the loop controller. Based on the particular personality code received from the loop controller 10 and stored in the EEPROM 126, the microcontroller 96 can determine the type of signals that are to be sent to or received from each of terminal contacts 5 through 14 (i.e., TB2-5 through TB2-8, TB3-9 through TB3-12, TB4-13 and TB4-14). Accordingly, by connecting the conventional devices to be controlled by the universal module 24 to its appropriate terminal contacts, the module adapts these conventional devices within distributed intelligence systems.

The invention having been thus described with particular reference to the preferred forms thereof, it will be obvious that various changes and modifications may be made therein without departing from the spirit and scope of the invention as defined in the appended claims.

Wherefore, we claim:

1. An alarm system for detecting and warning of the presence of various conditions by means of transponders located in a plurality of zones comprising:

a loop controller having a plurality of supply lines extending to said transponders;

a module, within each of said transponders, connected to said plurality of supply lines, said module being capable of initiating communication of the condition in its respective zone to said loop controller; and means for variably determining specific different personalities of said module such that said module functions selectively in a variety of specific ways, wherein said means for variably determining includes means for selectively storing specific configuration data in said module to establish said respective specific personalities until such time as a new personality is selected;

a plurality of device containing circuits coupled to said module; and means, responsive to the storage of specific configuration data, for selecting respective modes of operation for said circuits.

2. The alarm system of claim 1, wherein said module includes means for receiving said configuration data from said loop controller.

3. The alarm system of claim 1, wherein said module includes at least one microprocessor-controlled register for storing said configuration data.

4. The alarm system of claim 1, wherein said plurality of zones includes at least one non-intelligent device, connected to said module, selected from the group consisting of: heat detectors, fire alarm pull stations, door closures, fan shutdown, and audio and visual signal operators.

5. The alarm system of claim 1, further comprising means for selecting different circuit paths responsive to the different personalities.

6. The alarm system of claim 5, wherein said different circuit paths provide Class A and Class B operation for said devices.

7. The alarm system of claim 5, wherein said different personalities include personalities that control devices for 1-channel operation and other personalities that control devices for 2-channel operation.

8. The alarm system of claim 5, wherein said different personalities include at least one personality selected from the group consisting of: alarm latching, alarm latching-delayed, active non-latching, active latching, riser selector, riser selector with telephone ringtone, dual riser selector, dry contact, 2-wire smoke non-verified, 2-wire smoke verified, and signal output.

* * * * *